United States Patent [19]

West et al.

[11] Patent Number: 4,701,616

[45] Date of Patent: Oct. 20, 1987

[54] APPARATUS AND METHOD FOR AIMING A PARTICLE BEAM

[75] Inventors: William P. West, Poway, Calif.; Clifford H. Muller, III, Colorado Springs, Colo.

[73] Assignee: GA Technologies Inc., San Diego, Calif.

[21] Appl. No.: 829,280

[22] Filed: Feb. 13, 1986

[51] Int. Cl.[4] ..... H05H 3/00

[52] U.S. Cl. ..... 250/251; 250/397; 250/491.1

[58] Field of Search ..... 250/251, 397, 491.1; 33/227, 233, 234

[56] References Cited

U.S. PATENT DOCUMENTS 3,842,279 10/1974 Schumacher ..... 250/397

4,260,893 4/1981 Bakker et al. ..... 250/397

*Primary Examiner*—Craig E. Church

*Assistant Examiner*—Jack I. Berman

*Attorney, Agent, or Firm*—Fitch, Even, Tabin & Flannery

[57] ABSTRACT

In aiming a neutral particle beam cross hair sights are first lined up relative to a target, and then the beam is lined up with the cross hair sights. Blocking means is disposed in a particle beam so as to absorb, scatter and/or otherwise remove particles from the beam and thereby create a downstream shadow of predetermined size and shape in the beam. Shadow detecting means is disposed in the beam downstream of the blocking means and senses the particles and emits steering signals systematically related to the extent to which the shadow detecting means is in the shadow of the blocking means. Aligning means lines up the blocking means and the shadow means in a desired direction relative to the target. The steering signals are thus systematically related to the direction of the beam relative to the desired direction. The steering signal from the sensing means is used to direct the neutral particle beam to hit the target.

11 Claims, 8 Drawing Figures

APPARATUS AND METHOD FOR AIMING A PARTICLE BEAM

This invention relates to particle beams and more particularly to methods and apparatus for sensing the direction of and aiming a particle beam.

BACKGROUND OF THE INVENTION

Neutral particle beam devices presently under construction will be capable of producing hydrogen neutral beams having energies in the range of approximately 10 MeV and higher. Much more powerful beam devices are contemplated. If these devices are located in space they will be capable of delivering these beams to targets located at distances of many kilometers.

The aiming of charged particle beams has been well developed and used extensively in sending charged particle beams down long linear accelerators.

A technique involving laser resonance fluorescence has been proposed for sensing the direction of a neutral beam. See G. Rohringer, "Particle Beam Diagnostics by Resonant Scattering" (U), General Research Corp. Report No. CR-1-783(1977). In this technique the Doppler shift in laser induced fluorescence is measured to determine the angle between the fluorescence producing laser beam and the particle beam. This system is expensive and complicated, and requires that the beam energy and laser wavelength be known to a high accuracy.

Cross hairs have been used in ordinary telescopic rifle sights for aligning weapons for many years. The telescopic rifle sights work by aligning two sets of cross hairs optically with the intended target. The cross hairs have previously been aligned with the bore of the rifle, so that when the cross hairs are aligned the rifle is on target.

SUMMARY OF THE INVENTION

It is not generally feasible to aim a neutral particle beam precisely at a target merely by aligning the beam producing device with the target, since the direction of the beam produced by the device is subject to substantial variation as a result of thermal and mechanical distortion of the accelerator column and post acceleration optics, including neutralization and focusing of the beam. The seriousness of these distortions results from the fact that the ion accelerator and ion optics are many tens of meters in length. Additional aiming inaccuracy results from inaccuracies and variations in the various power supplies controlling the system.

One method of aiming a neutral particle beam with precision is first to line up cross hair sights with the target and then to line up the beam with the sights. This invention is based on that principle.

Blocking means is disposed in a particle beam so as to absorb, scatter and/or otherwise remove particles from the beam and thereby create a downstream shadow of predetermined size and shape in the beam. Shadow detecting means is disposed in the beam downstream of the blocking means and senses the beam particles and emits steering signals systematically related to the extent to which the shadow means is in the shadow of the blocking means. Aligning means lines up the blocking means and the shadow means in a desired direction with respect to the target. The steering signals are thus systematically related to the direction of the beam relative to the desired direction. The steering signal from the sensing means is used to direct the neutral particle beam to hit the target, providing an extremely accurate method of aiming the beam to hit the target.

DESCRIPTION OF PREFERRED EMBODIMENT

The basic principles of the invention can be described by reference to FIGS. 1, 2 and 3.

Figure 1:
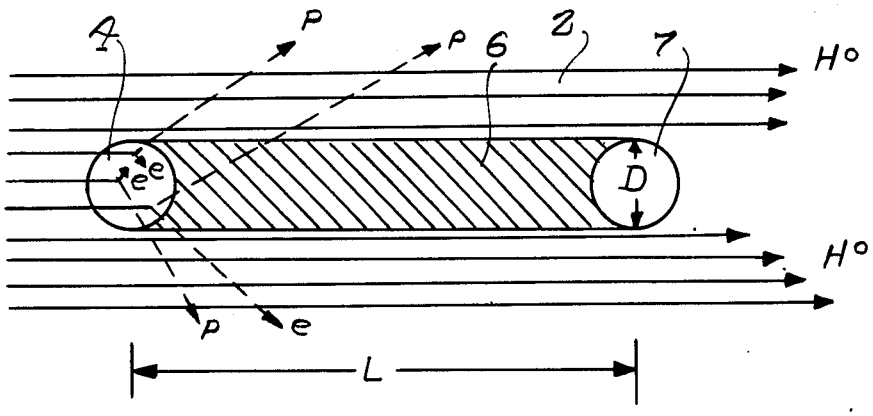
FIG. 1 is diagrammatic representation of two fibers in the path of a neutral particle beam, one fiber in the shadow of the other.

"Shadowing" of a fast collinear or nearly collinear neutral hydrogen H° beam 2 by an upstream blocking fiber 4 is shown in FIG. 1. The blocking fiber 4, viewed axially, intercepts a small section of the beam 2. Essentially all of the H° atoms in the beam intercepted by the blocking fiber 4 are stripped from the beam 2 and separated into electrons e and protons p. Most of the electrons and protons are stopped in the fiber or are scattered at large angles. The result is a "shadow" 6 downstream from the fiber 4, with substantially no fast particles in the shadow.

Fast particles will be incident on a shadow detecting fiber 7 disposed downstream in the beam 2 only if shadow detecting fiber 7 is out of the shadow 6 of the blocking fiber 4. Collisions of any beam particles with the shadow detecting fiber 7 will result in an electric charge buildup on the shadow detecting fiber 7 as discussed below. Incident fast particles can be detected by the current generated as a result of this charge buildup. Thus, if the beam 2 is aligned with the blocking fiber 4 and the shadow detecting fiber 7, the shadow detecting fiber 7 will produce no or relatively small current. However, if the beam direction is misaligned, a significant current will be generated which can be detected with a standard microammeter such as a Keithly Instrument Model 417 microammeter. Alternative techniques for sensing the incident fast particles include detection of the temperature rise in the shadow detecting fiber 7 due to the energy deposited by the beam particles, and detecting of electrons scattered by the shadow detecting fiber 7 using a pinhole camera and a spatially resolving microchannel plate. Another technique involves using a shadow detecting fiber 7 containing a scintillator, the scintillations resulting from the incident beam being imaged onto a spatially resolving detector.

If the blocking fiber 4 and the shadow detecting fiber 7 are sufficiently thin, they will absorb negligible energy from the incident particles and not be destroyed by the beam. For beam energies of about 10 MeV, graphite fibers smaller than 50 microns diameter will survive beam fluxes currently contemplated for neutral beam devices. At higher beam energies, larger fibers could be used. Preferably the fiber should have a diameter larger than 1 micron to assure sufficient shadow.

Figure 2:
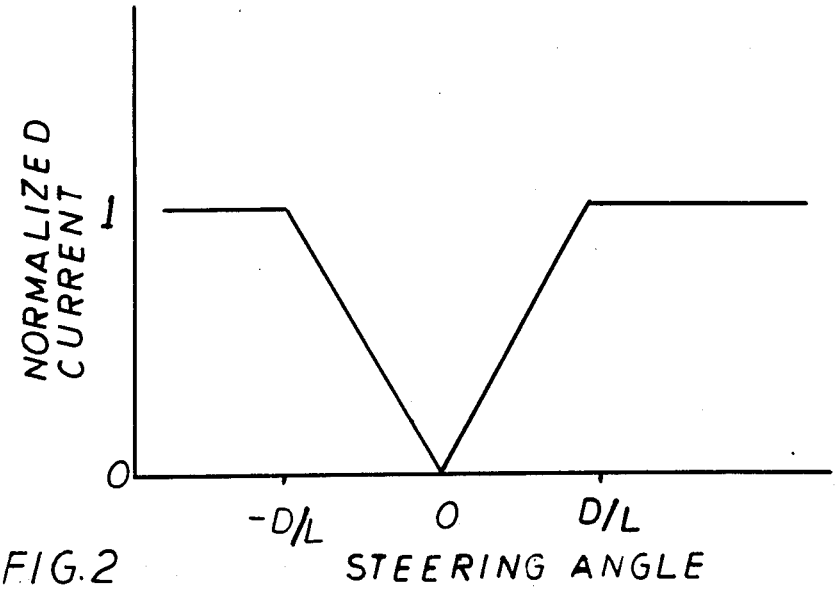
FIG. 2 is an idealized graph of the normalized current induced in a shadow fiber as a function of steering angle.
Figure 3:
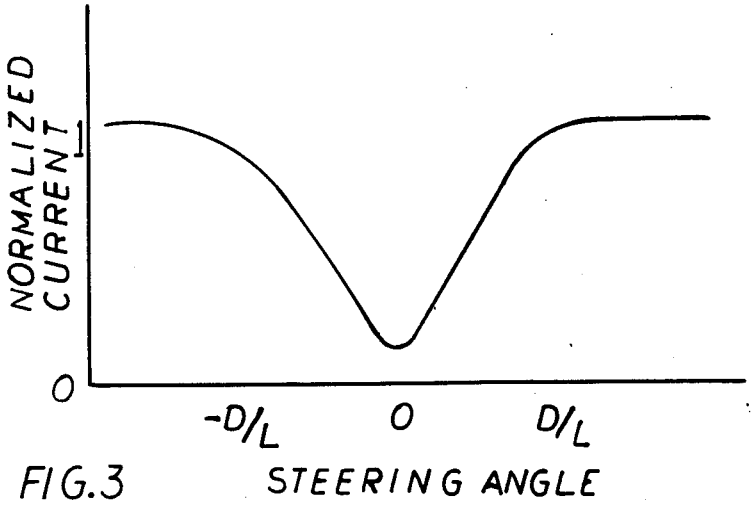
FIG. 3 is a more realistic graph of current as a function of steering angle similar to that of FIG. 2 but under more realistic conditions.

Shown in FIG. 2 is an idealized plot of the normalized current generated in the shadow detecting fiber 7 as a function of the beam steering angle, that is, the difference between the beam direction and the direction of alignment of a blocking fiber 4 and a shadow detecting fiber 7 in respect to misalignment normal to the respective fibers, assuming equal diameters of the blocking and sensing fibers, assuming no fiber vibration, and assuming the beam is perfectly collimated, i.e., with no divergence. A real beam will have finite divergence, there will be some fiber vibration and there will be sources of noise, resulting in a graph of current as a function of steering angle more like that shown in FIG. 3. The accuracy to which the centroid of the dip in the current can be located is dependent on the signal to noise ratio. With adequate signal averaging times, beam direction can be determined to an accuracy of about 0.1 D/L, where D is the diameter of both the blocking and shadow detecting fibers 4, 7 and L is the distance between them.

Figure 4:
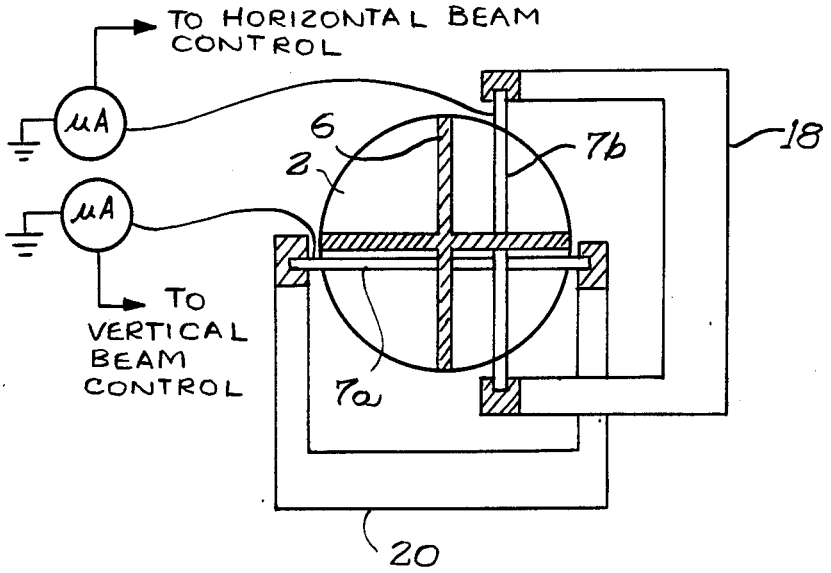
FIG. 4 is a partially schematic, partially diagrammatic representation of cross hair shadow fibers in a neutral beam but not quite in the shadow of cross hair blocking fibers.
Figure 5:
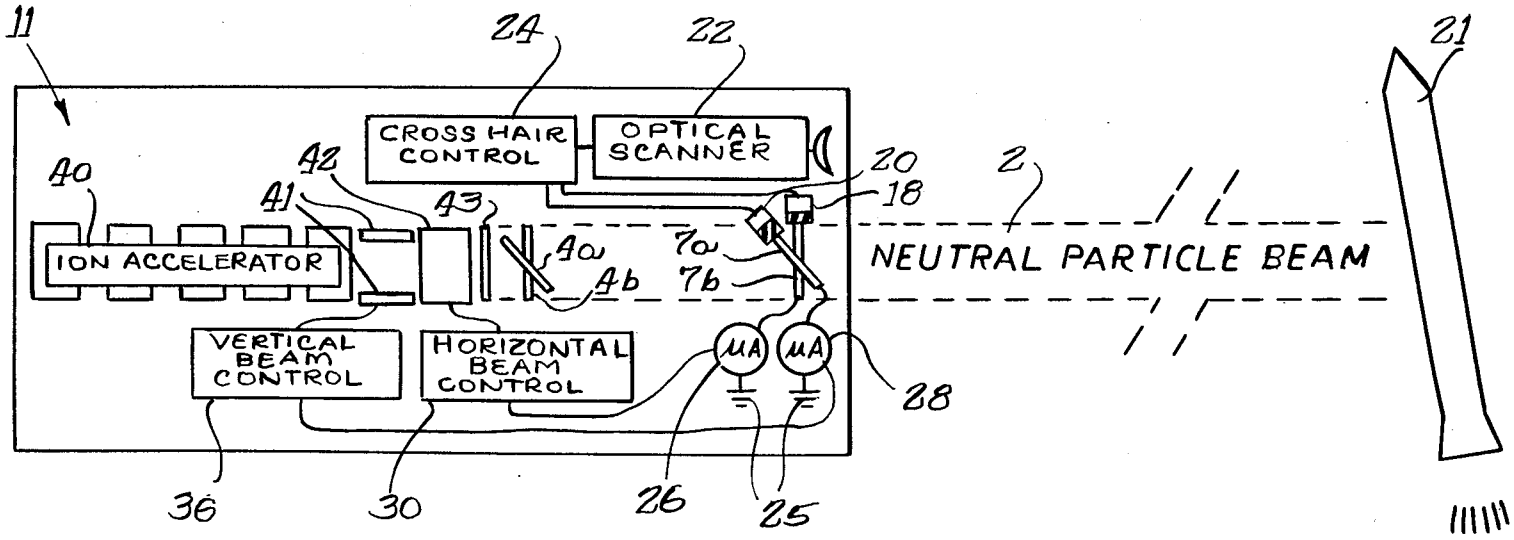
FIG. 5 is a partially schematic, partially diagrammatic representation of one embodiment of this invention.
Figure 7:
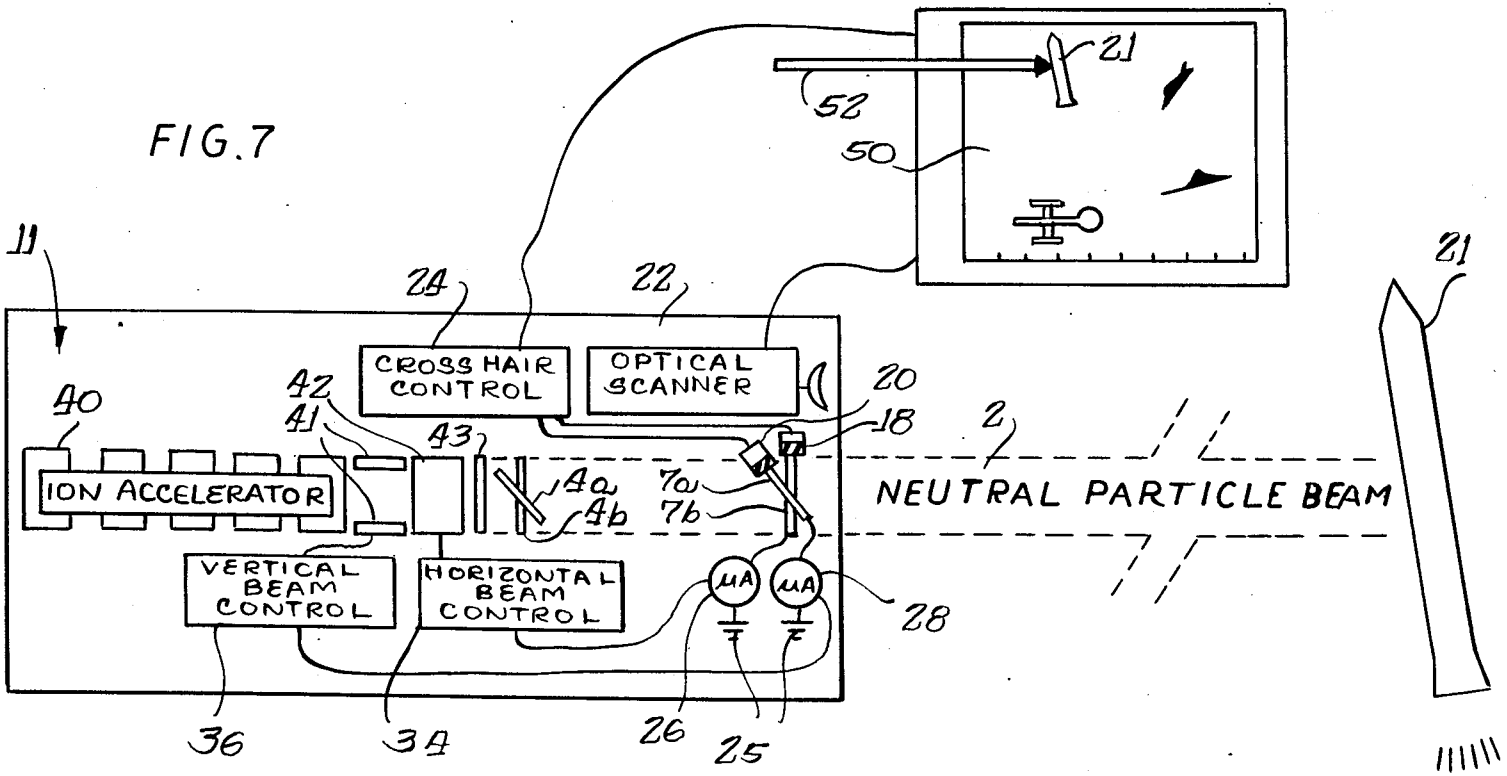
FIG. 7 is a partially schematic, partially diagrammatic representation of an alternative embodiment of this invention.

One particular preferred embodiment of this invention is shown in FIGS. 4 and 5. This embodiment uses as blocking fibers 4, a cross hair arrangement of two carbon fibers 4*a* and 4*b* having diameters of about 10 μm. The blocking fibers 4*a* and 4*b* mounted perpendicular to each other. The blocking fibers 4*a* and 4*b* are placed in the path of a neutral hydrogen beam 2 produced by neutral beam device 11. The neutral beam device 11 is comprised of an ion accelerator 40, deflecting coils 41 and 42 and a neutralizer 43. Blocking fibers 4*a* and 4*b* cast a cross shadow 6 in the neutral beam 2, shown in FIG. 4 going into the sheet. Shadow detecting cross hair fibers 7*a* and 7*b* are mounted one meter downstream of blocking fibers 4*a* and 4*b* on respective positioning units 18 and 20 which are controlled by a cross hair control unit 24 in response to coordinate signals from an optical scanning device 22 which detects a target 21. The alignment unit 24 lines up blocking fibers 4*a* and 4*b* and the respective shadow fibers 7*b* and 7*b* with a desired direction relative to the target 21. The optical scanning device 22 of this preferred embodiment may be of the type of heat sensitive infrared detectors currently used by the military to locate the position of enemy missiles accurately. The positioning and alignment of shadow detecting fibers 7*a* and 7*b* based on signals from the optical scanning device 22 can be achieved without human interference using feedback and other electronic circuitry well known in the art. In another preferred embodiment as shown in FIG. 7 potential targets detected by the optical scanning device 22 could be displayed on a screen 50, and a human operator could manually determine the alignment of the cross hairs with respect to any particular target 21 so shown so as to direct the beam to hit that specific target. In this alternative embodiment a "mouse" 52 is used to direct the alignment of the cross hairs 4*a* and 4*b* and 7*a* and 7*b* with respect to the target 21. Alternative detection units such as radar units could be used in place of optical scanning devices. The neutral beam control system could alternatively comprise means (not shown) for gross directional control and for placing the system in various states of readiness for operation.

Sensors 26 and 28 are fast microammeters capable of detecting currents in the range of 0.1 to 100 microamperes. The interaction of the neutral beam with the atoms in the carbon fibers 7*a* and 7*b* cause electrons to be stripped off the hydrogen atoms in the beam 2 intercepted by the fibers 7*a* and 7*b*. Many of these electrons will be collected on the fibers 7*a* and 7*b* causing a charge to build up on fibers 7*a* and 7*b* and a current to flow through respective microammeters 28 and 26 to ground 25. The neutral beam 2 also knocks some electrons out of the detecting fibers 7*a* and 7*b*. The neutral beam may heat the fibers sufficiently to produce thermionic emission of electrons. In the preferred embodiment this subtracts from the current produced by electrons being stripped from the hydrogen atom in the beam and captured on fibers 7*a* and 7*b*. In other embodiments fibers could be constructed so that the population of knocked out electrons or thermionically emitted electrons dominate the population of stripped and captured electrons. In this latter case the current would flow in the opposite direction. In all cases minimum absolute current is measured when the detecting fibers 7 are lined up with the blocking fibers 4. The proportion of knocked out electrons can be reduced by choosing fibers with greater diameter or materials with a lower secondary electron emission coefficient. Care must be taken to assure that the stripped electrons and the knocked out electrons are not approximately equal. The magnitude of knocked out electrons and thermionically emitted electrons is reduced by biasing the shadow detecting fibers 7*a* and 7*b* with a small positive voltage. A small negative bias on the fibers reduces noise due to capture on the fiber of stray electrons and increases the magnitude of knockout electrons and thermionically emitted electrons.

The horizontal deflecting coils 42 and the vertical deflecting coils 41 are controlled respectively by control units 34 and 36 to align the beam 2 with blocking fibers 4*a* and 4*b* and shadow detecting fibers 7*a* and 7*b* and thus to produce minimum currents in microammeters 26 and 28. Beam control units 34 and 36 could be operated by human control, if the target were stationary or moving slowly enough, but preferably they comprise suitable feedback circuits such that the beam is continually adjusted to maintain minimum current in the respective shadow detecting fibers 7*a* and 7*b* and to cause the beam to follow any movement in the fibers. One preferred method of doing this is to provide for a very slight, continuous dithering of the beam, both horizontally and vertically, moving in one direction (e.g., left) until the current begins to increase, then moving in the other direction (e.g., right) until the current begins to increase, then moving back in the first direction, etc. In the preferred embodiment the diameter of the beam is large, about 20 cm, in relation to the degree of steering freedom of the deflecting coils 42 and 41 positioning units 18 and 20 so that there is no possibility that the shadow detecting fibers 7*a* and 7*b* could be outside of the path of the beam 2. Therefore, the only minimum current position for shadow detecting fibers 7*a* and 7*b* is in the shadow of the blocking fibers 4*a* and 4*b*.

To estimate the accuracy of this preferred embodiment of this invention it is reasonable to assume that the target can be detected to an accuracy of 0.5 m at 100 km (an angular detection accuracy, $\theta_d$, of about 5 microradians). Positioning devices are presently available for positioning the shadow cross hairs with an accuracy of 3 microns. (An example of such a device is Klinger Scientific Instruments, Model UT, 100 stages.) Since the blocking and shadow detecting cross hairs are one meter apart, this introduces potential angular position error, $\theta_p$ of 3 microradians. As indicated above, the beam can be lined up with the cross hairs with an accuracy of $\theta_b$ of about 0.1 D/L. With a fiber diameter 10 microns, $\theta_b$ is about 1.0 microradians. A rough estimate of the total expected angular accuracy, $\theta_t$, would be the square root of the sum of the squares of these sources of error or $\theta_t=6$ microradians. Therefore, a particle beam system utilizing this preferred embodiment would be accurate enough to strike targets at 100 km with the center of the beam with an accuracy of about 60 cm.

Figure 6A:
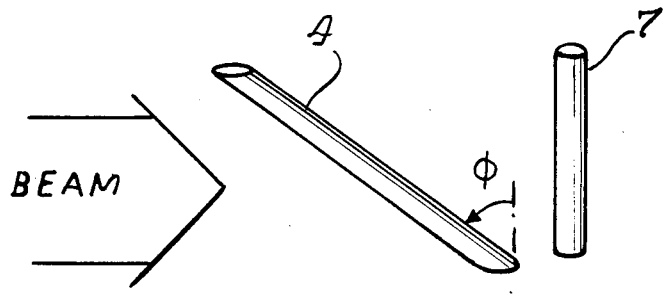
FIGS. 6A and 6B are partially schematic, partially diagrammatic representations of alternative shadow fiber arrangements.

Another embodiment shown in FIG. 6A provides both coarse and fine steering information utilizing a single blocking fiber 4 and a single shadow detecting fiber 7. In this arrangement, the blocking fiber 4 is mounted in the beam at an angle $\phi$ of about 45° relative to the beam direction, while the shadow fiber 7 is still perpendicular to the beam.

The bottom part of the blocking fiber is mounted close to the shadow fiber, and the top of the blocking fiber is farther away from the shadow fiber. With this arrangement, a full shadow is measured by the second fiber only when the beam direction lies in the plane formed by the two fibers. When the beam direction deviates from this plane, a portion of the shadow wire is exposed to the beam. The magnitude of the signal from the shadow wire is a measure of the deviation of the beam direction from the plane of the fibers. The magnitude of the signal, as the beam direction is varied, is sharp when the beam direction is close to the fiber plane, thus giving high resolution. When the beam direction is far from the fiber plane, the angular resolution is more coarse.

Figure 6B:
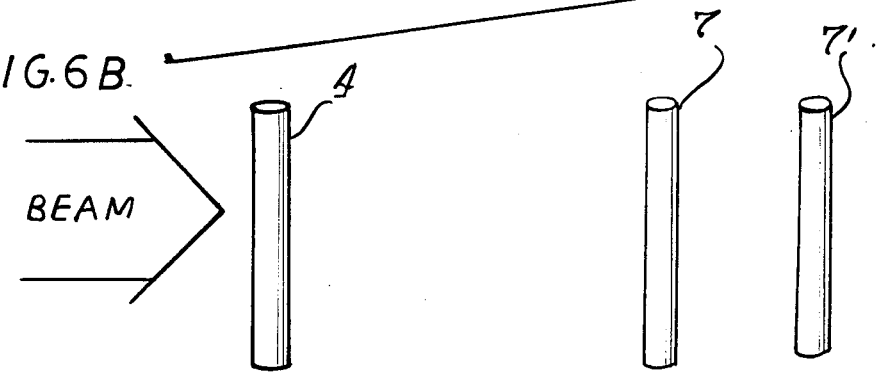

An alternative embodiment shown in FIG. 6B providing both a coarse and fine directional measurement results from placing an additional shadow detecting fiber 7' a short distance downstream from the shadow detecting fiber 7.

In this diagram, the shadow from the blocking fiber 4 misses the shadow detecting fiber 7 because the beam is grossly missteered. However, the shadow from the shadow detecting fiber 7 is partially intercepted by the additional shadow detecting fiber 7' due to the small separation between fibers 7 and 7'. A coarse steering control is thus provided by minimizing the signal seen from the fiber 7', and a fine control is provided by minimizing the signal seen from the fiber 7 due to the blocking fiber 4. A further advantage of this scheme (two fibers downstream) is that if one of the shadow detecting fibers, 7 or 7', should break, the remaining fiber can still be used for fine-control steering by using the shadow of the blocking fiber 4.

Persons skilled in the art will recognize that sighting devices other than cross hairs could be used to line up the beam with the target. For example, sights in the form of a dot or circle could be used. Persons skilled in the art will also recognize that rather than adjusting the beam direction with deflecting coils as described above, the direction of the beam could be adjusted based on the signal from the sensing means by orienting the beam device or at least the latter portion of the beam device to aim the beam to hit the target.

The aiming device and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinabove described being merely preferred or exemplary embodiments thereof.

What is claimed is:

1. In a device for firing a beam of particles, which device includes means for generating a beam of highly accelerated particles, an apparatus for aiming said beam of highly accelerated particles at a target comprising: blocking means for blocking particles from a predetermined portion of said beam so as to create a shadow of predetermined size and shape downstream thereof; shadow detecting means for responding to particles in said beam downstream of said blocking means by producing steering signals systematically related to the blocking of particles by said blocking means; aligning means for aligning said blocking means and said shadow detecting means in a desired direction so as to make said steering signals systematically related to the direction of said beam relative to the desired direction; and aiming means for directing said particle beam to hit said target.

2. The apparatus according to claim 1 wherein said blocking means and said shadow detecting means comprise thin fibers.

3. The apparatus according to claim 2 wherein said blocking means and said shadow detecting means comprise cross hairs.

4. The apparatus according to claim 3 wherein said thin fibers have diameters smaller than 100 microns.

5. The apparatus according to claim 1 wherein said shadow detecting means comprises a microammeter for detecting the flow of electrical charge generated in said shadow detecting means.

6. The apparatus according to claim 1 wherein said shadow detecting means comprises a heat detector capable of detecting a change in temperature of said shadow detecting means.

7. The apparatus according to claim 1 wherein said shadow detecting means comprises a pin hole camera and spacially revolving microchannel plate detector to detect the image of the electrons scattered by said shadow detecting means.

8. The apparatus according to claim 1 wherein said particle beam is generated by neutralizing an ion beam and said aiming means comprises a plurality of deflecting coils for changing the direction of said ion beam prior to its being neutralized.

9. The apparatus according to claim 1 wherein said particle beam is generated by a beam generator and said aiming means comprises means for orienting at least a portion of said beam generator to aim said beam at the target.

10. The apparatus according to claim 1 wherein said aligning means comprises an optical scanning means for detecting said target.

11. A method of aiming a beam of highly accelerated particles at a target comprising the steps of:

disposing a first object in said beam so as to create a shadow of predetermined size and shape downstream thereof in said beam;

disposing a second object in said beam downstream of said first object, aligning said first object and said second object in a desired direction for the beam to hit said target;

detecting the extent to which said second object is in said shadow of said first object; and adjusting the direction of said beam based on the extent to which said first object is in the shadow of said second object so that said beam is directed in the direction for hitting said target.

* * * * *